US009912064B2

(12) United States Patent
Ferreira

(10) Patent No.: US 9,912,064 B2
(45) Date of Patent: Mar. 6, 2018

(54) SEGMENTED VARIABLE-CONFIGURATION RADIO ANTENNA

(71) Applicant: David Henry Ferreira, Cedar Park, TX (US)

(72) Inventor: David Henry Ferreira, Cedar Park, TX (US)

( * ) Notice: Subject to any disclaimer, the term of this patent is extended or adjusted under 35 U.S.C. 154(b) by 0 days.

(21) Appl. No.: 15/152,371

(22) Filed: May 11, 2016

(65) Prior Publication Data

US 2017/0033456 A1 Feb. 2, 2017

Related U.S. Application Data

(60) Provisional application No. 62/231,132, filed on Jun. 26, 2015.

(51) Int. Cl.

| | |
|---|---|
| ***H01Q 9/20*** | (2006.01) |
| ***H01Q 1/08*** | (2006.01) |
| ***H01Q 9/16*** | (2006.01) |
| ***H01Q 1/14*** | (2006.01) |
| ***H01Q 21/30*** | (2006.01) |

(52) U.S. Cl.

CPC ..... *H01Q 9/20* (2013.01); *H01Q 1/088* (2013.01); *H01Q 1/14* (2013.01); *H01Q 9/16* (2013.01); *H01Q 21/30* (2013.01)

(58) Field of Classification Search

CPC H01Q 9/14; H01Q 9/145; H01Q 9/16; H01Q 9/20; H01Q 1/14; H01Q 1/08; H01Q 1/088

USPC ..... 343/724

See application file for complete search history.

(56) References Cited

U.S. PATENT DOCUMENTS 2,998,604 A * 8/1961 Seeley ..... H01Q 1/14 343/736

* cited by examiner

*Primary Examiner* — Robert Karacsony

(57) ABSTRACT

A segmented radio antenna that uses electrically conductive quick connect/disconnect devices between segments to accomplish a conversion from efficiency on one band to efficiency on another band AND/OR to convert quickly and easy between center-fed and end-fed (or a variety of feed-point configurations).

The innovative use of flexible wire segments and connectors reduces the overall weight and cost of the antenna when compared to the use of traps or telescoping antennas.

4 Claims, 4 Drawing Sheets

SEGMENTED VARIABLE-CONFIGURATION RADIO ANTENNA

BACKGROUND OF THE INVENTION

The present invention is in the technical field of radio communications. More particularly, the present invention is in the technical field of antenna design.

A dipole antenna is the simplest form of radio antenna. It consists of two electrically-conductive elements positioned such that passing radio waves cause a voltage differential between the two elements.

In the case of radio signal reception, this voltage differential, however small, is passed through a feed line to a radio frequency (RF) receiver where it is converted into audio, video, text or other content.

In the case of transmission, an oscillating voltage differential is generated by a radio transmitter and passed to the antenna by way of a feed line, creating radio waves in space.

Dipole antennas may be "balanced", having two elements of equal lengths with a feed point in the center. Or they may be "end-fed" with one element making up nearly the entire length of the antenna, with the feed point at or near the very end of the configuration. In reality, this type of antenna may be constructed with the feed point at any point between the end points with an impedance matching transformer used just below the feed point.

This type of antenna may be linear, with the two elements occupying a single line in space (or nearly a single line). Or they may be placed in an "inverted V" configuration with the feed point elevated above the two end points. Indeed, there are many serviceable configurations of a dipole antenna.

Changes to the position of the feed point and/or the configuration of the elements may cause a change or imbalance in the overall electrical impedance of the antenna. (Impedance is a combination of inductance, capacitance, and resistance and is measured in Ohms, signified by the capital Greek letter, Omega.)

Differences between the impedance of the antenna and the required impedance of the attached radio device are mitigated by the use of an "impedance matching transformer".

A dipole antenna of a given overall length is most effective at receiving or emitting radio waves whose wavelength is TWICE the overall length of the antenna (with a correction applied for different element materials and insulations). In the case of reception, this ratio of antenna length to wavelength produces the maximum voltage differential across the elements. Conversely, during transmission, this ratio produces the maximum amplitude of radio wave for a given voltage differential applied to the antenna.

The impedance of a fixed-length dipole antenna changes across the frequency spectrum. The impedance of an antenna of length L may be 50 Ohms at 14.050 MHz, but may be 5 Ohms at 14.450 MHz.

Likewise, the standing wave ratio (SWR) of an given-length antenna will change across the frequency spectrum, changing the antenna efficiency as frequency changes while length is held constant.

Therefore, for a given frequency or frequency band, a specific overall length of dipole antenna is highly preferable for maximum efficiency.

An external antenna tuner may be used to compensate for an antenna that is not ideally matched to the frequency in use, however, this tuner cannot make an inefficient antenna ideally efficient, it can only make the antenna usable (such as not to damage radio equipment).

Ideally, for maximum radiating efficiency, with or without the use of an antenna tuner, the overall length of the dipole antenna is at or near ½ the wavelength of the frequency in use.

Traditionally, there have been two methods for creating dipole antennas suitable for multiple bands: telescoping and the use of traps.

Telescoping antenna elements are highly familiar in the form of the typical home TV rabbit-ear antennas. This device, however, becomes cumbersome and difficult to sustain at longer wavelengths—imagine a rabbit-ear antenna where each element telescopes out to 10 meters.

For longer HF applications, traps have been traditionally used. A trap is essentially a small inductor-capacitor circuit which has a fix resonant frequency which falls between the two bands it separates. The result is a fixed-length antenna which approaches maximum efficiency on multiple bands. (The costs of this solution are financial, inconvenience and in weight.)

SUMMARY OF THE INVENTION

The present invention is a novel antenna construction technique which can be applied, as an improvement, to a variety of existing antenna designs which uses rigid or flexible wire segments which can be attached or detached quickly and easily using low-loss, electrically conductive, quick connect/disconnect connectors paired with a securing device such as, but not limited to, a standard o-ring or Zip-Strip, to alter the overall length of the antenna elements to make the antenna highly efficient on a variety of frequencies or frequency bands—OR—to quickly reconfigure the feed-point location along the same antenna.

This design is lighter in weight, cost effective and convenient when compared to fixed-length antennas, telescopic antennas or antennas using traps.

A third advantage is the quick and easy conversion from center-fed to end-fed (or to a variety of feed point positions). Segments of the antenna may be quickly and easily rearranged such that the feed point is at or near the end of the antenna and an impedance matching transformer may be applied. This quickly and easily converts the antenna from a balanced dipole to an end-fed dipole—a conversion which is difficult or impossible when using fixed-length wire, wire with traps or telescopic antennas.

As mentioned above, this antenna design feature may be applied to a variety of existing antenna designs such as, but not limited to center-fed dipole antennas, end-fed dipole antennas, inverted-V dipoles, Eyring (ELPA) antennas (which is essentially an array of dipole antennas), and others.

The improvement presented here is particularly relevant to the Eyring (ELPA) antenna and other tactical antennas, where stealth, speed and radiation efficiency are high-priority attributes of the application.

We believe this methodology will yield a performance improvement over the traditional Eyring design where elements are trimmed by taking up wire onto a (plastic) spool which creates both inductance and capacitance to electrically alter the length of the element. Since capacitance and inductance in an antenna can be mutually cancelling and inductance at the end of an antenna leg yields sub-optimal efficiency, we believe our improvement would yield a performance increase.

We also believe this methodology, when applied to the Eyring (ELPA) antenna will yield improved speed and stealth, and therefore reduced risk to human life by allowing the user to re-tune the antenna by simply removing a fixed, pre-measured length of antenna element rather than pacing out and spooling up a length of antenna wire for each of the four legs.

REFERENCES CITED IN THIS APPLICATION

Straw, et al.: The ARRL Antenna Book, 21st Edition, February 2007, pp. 7.9, 16.3, 16.4

Silver, Wilson: The ARRL Extra Class License Manual, 10th Edition, March 2012, pp. 4.15

BRIEF DESCRIPTION OF THE DRAWINGS

FIG. 1 is a perspective view of the antenna in center-fed dipole configuration constituting the best reduction to practice of my invention that I am aware of.

DETAILED DESCRIPTION OF THE INVENTION

The invention described here is an antenna created in rigid or flexible (coilable) wire segments which can be attached or detached quickly and easily with electrically conductive, quick connect/disconnect connectors to alter the overall length of the antenna to make it highly efficient on a variety of frequencies or frequency bands.

This design is lighter in weight, cost effective and convenient when compared to fixed-length antennas, telescopic antennas or antennas using traps.

A third advantage is the quick and easy conversion from center-fed to end-fed (or to a variety of feed point positions). Segments of the antenna may be quickly and easily rearranged such that the feed point is at or near the end of the antenna and an impedance matching transformer may be applied. This quickly and easily converts the antenna from a balanced dipole to an end-fed dipole—a conversion which is difficult or impossible when using fixed-length wire, wire with traps or telescopic antennas.

Example 1

A user who is communicating on 10 meter band using segment "A", may switch to 15 meter band simply by snapping in place one or more additional wire segments (segment "B") onto the end of their antenna. This additional segment would be trimmed such that, when combined with segment "A", the overall antenna length is optimal for 15 meter band frequencies.

Example 2

A user is hiking/camping cross-country. At site A, they are camped among tall trees and user has his antenna configured as center-fed with segments in place for efficiency on the 20 meter band. The next day, user hikes 10 miles to a site where there is only 1 tree and no other tall structures. User unsnaps his feed point from the middle of the antenna and snaps together the two polar segments of the antenna. She then quickly snaps her feed point onto the one end of the antenna and snaps a terminal connector (non-element, rope loop for hanging) on to the other feed point connector. User throws a weighted pilot string high up tree, connects rope and other terminal connector to other end of antenna and pulls one end of antenna high up into tree. The lower end of antenna is connected (insulated or not) to a spike in ground away from the tree. The result is a sloping end-fed dipole antenna.

Figure 1:
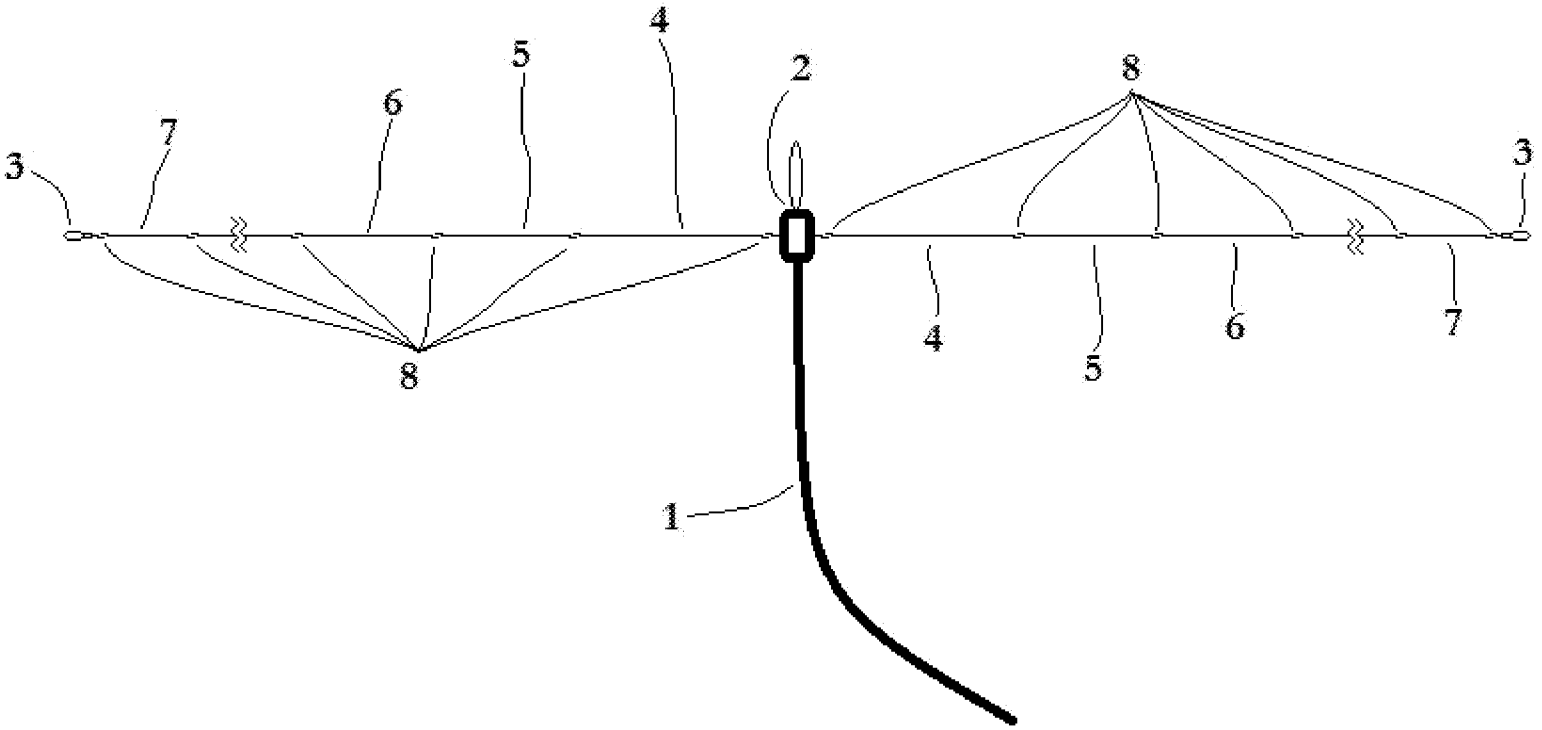

In FIG. 1, there is shown the convertible antenna in a center-fed dipole configuration convertible for hypothetical frequency Bands A through n where Band A has the highest frequencies (shortest wavelengths) supported by this antenna and Band n has the lowest frequencies. A feed line 1, is connected to a central feed point connector 2. The feed point connector divides the two conductors of the feed line and passes them in different directions to quick connect/disconnect connectors 8. Next is the segment for Band A, 4, which, in turn connects with connector 8 to the segment 5, which, in combination with segment 4 is trimmed for Band B. This scheme is continued through element segment 7, which, in concert with all preceding segments is trimmed for maximum efficiency on Band n. Finally, segment 7 is connected with connector 8 to terminator 3, which is nothing more than a connector 8 attached to a loop of synthetic rope which insulates the entire antenna electrically from ground or further electrical length (like a branch or post).

Figure 2:
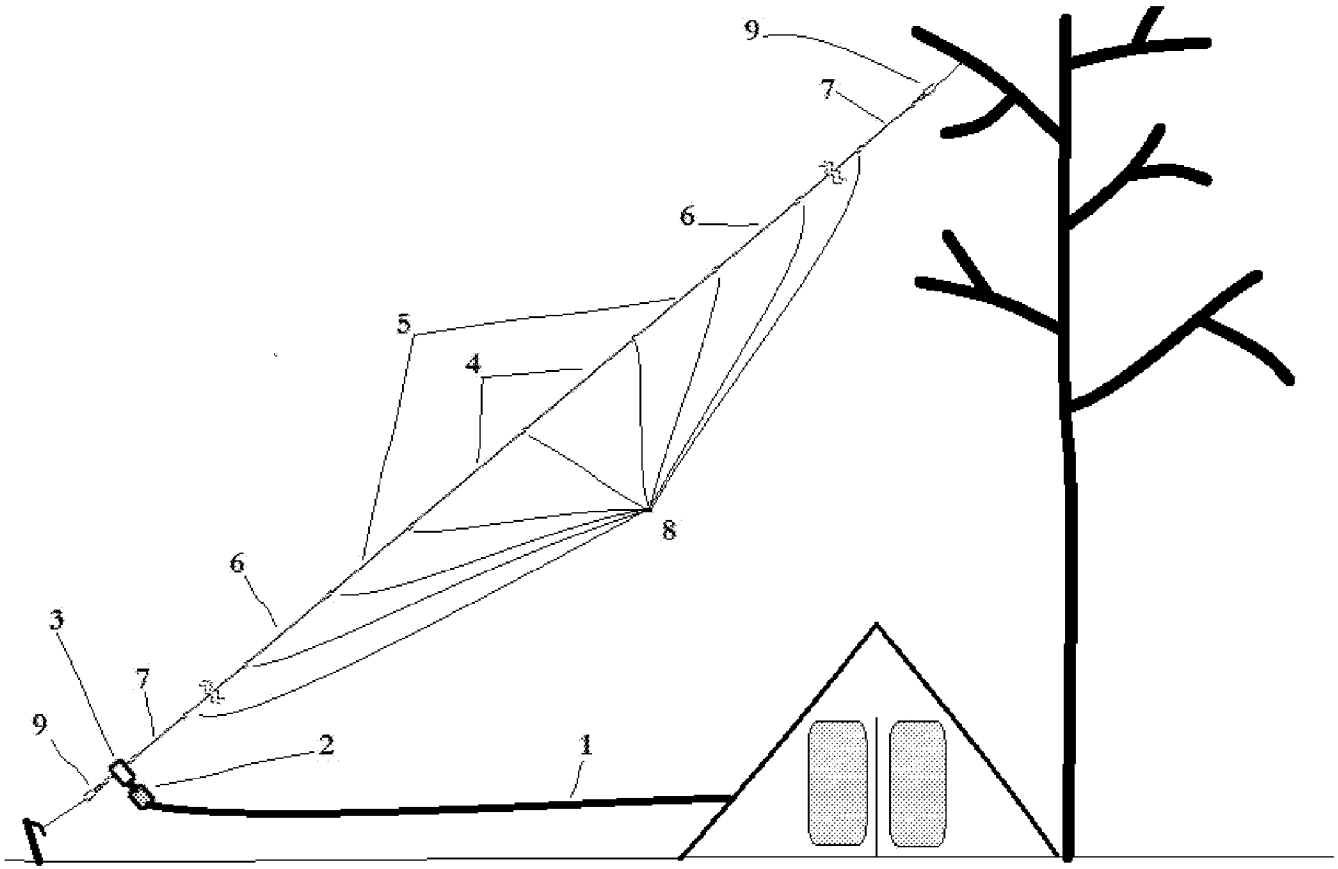
FIG. 2 is a perspective view of the antenna in an end-fed sloping dipole configuration

In FIG. 2, there is shown the convertible antenna in end-fed, sloping dipole configuration, again for hypothetical Bands A through n. Because of the change from a balanced antenna to an unbalanced antenna, the feed line 1, must be connected to an impedance matching transformer (a balun) 2. The balun 2, in turn, is connected to the end feed point connector 3. The feed point connector is connected on one side by quick connect/disconnect clips with a terminator 9 and on the other with a segment 7 for Band n, which is connected by quick connect/disconnect connector 8 to a segment 6, which is for Band B and so on through segments 5, 4, 5, 6, and 7; The order of segment placement does not matter in this configuration. The lower terminator 9 staked to the ground, while the upper terminator 9, may be held up by a tree limb.

Figure 3:
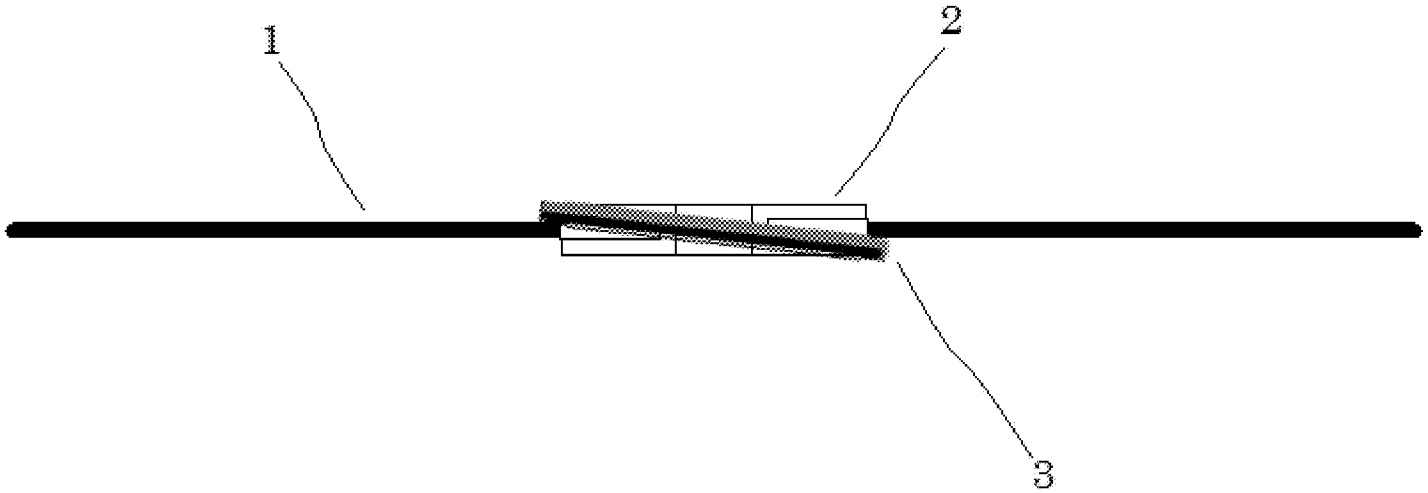
FIG. 3 is a detail view of a quick-connect/disconnect junction on the antenna held fast by a strong band such as an o-ring or "Zip Strip".

In FIG. 3, there is shown a detailed view of one of the several junctions between segments of the antenna. The various segments of the antenna wire 1, are joined by quick-connect/disconnect connectors 2, which are secured by a security band 3, such as an o-ring or a "zip strip".

Figure 4:
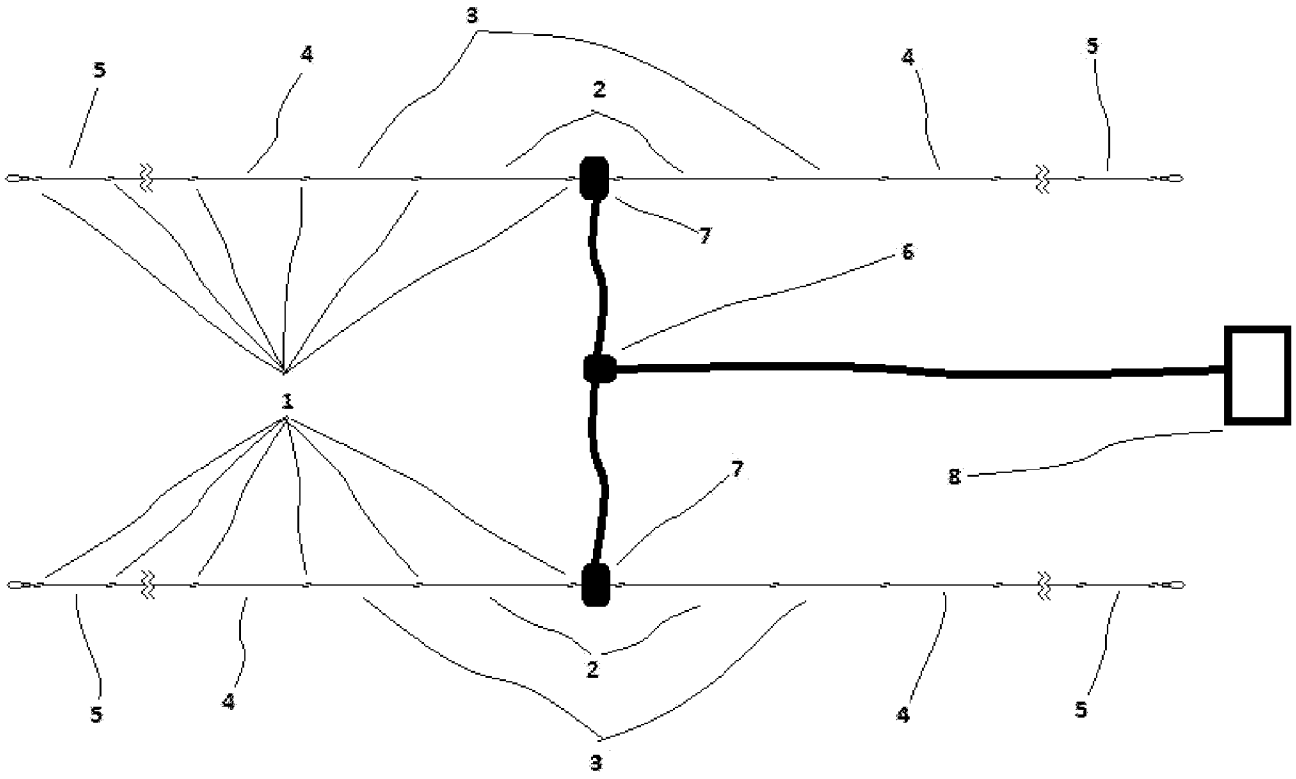
FIG. 4 is a detail view of an Eyring or ELPA (Eyring Low Profile Antenna) made band-convertible by applying our segmentation method in lieu of the traditional spooling of excess wire to trim the legs of the antenna.

In FIG. 4, there is shown the Eyring or ELPA (Eyring Low Profile Antenna) made convertible for hypothetical frequency Bands A through n where Band A has the highest frequencies (shortest wavelengths) supported by this antenna and Band n has the lowest frequencies. The radio equipment 8 is connected to a main feed line which connects to a splitter 6.

Two feed lines are connected to splitter 6 in the middle of the antenna field. The feed point connectors 7 divide the two conductors of each feed line and pass them in different directions to quick connect/disconnect connectors 1. Next are the segments for Band A, 2, which, in turn connect with connector 1 to the segments 3, which, in combination with segment 2 are trimmed for Band B. This scheme is continued through element segment 5, which, in concert with all preceding segments is trimmed for maximum efficiency on Band n.

This novel construction of the ELPA using our technique stands in contrast to the traditional method of trimming (tuning) an ELPA antenna which is to coil excess element wire onto spools which would remain attached at the end of each leg of the antenna. We believe our novel methodology yields increased performance do to the removal of the coils of wire on plastic spools which imply both large inductance and significant capacitance added at the end of each leg of the antenna.

The invention claimed is:

1. A segmented radio antenna the cumulative length of whose segments correspond to resonant frequencies in various targeted frequency bands and whose segments can be attached, removed or reconfigured to switch the resonant frequency or feed point position by the use of low-loss, quick-connect/quick-disconnect connectors;

a. wherein, the segmented antenna comprises one of a segmented dipole antenna, or;

b. a segmented Eyring Low Profile Antenna (ELPA) antenna.

2. The antennas of claim 1 wherein the connectors are selected from Anderson PowerPoles, Tyco AMP, Uchen or 3M.

3. The antennas of claim 2 wherein the connectors are combined with a securing band or clip; and wherein the securing band used is selected from an o-ring or Zip-Strip.

4. A methodology for adding, removing, or reconfiguring radio antenna elements, rigid or flexible, to change the resonant frequency using low-loss, quick-connect/quick-disconnect connectors; and wherein the connectors used are Anderson PowerPoles, Tyco AMP, Uchen or 3M; and wherein the connectors are combined with a securing band or clip; and wherein the securing band used is selected from an o-ring or Zip-Strip.

* * * * *